US007520499B2

(12) United States Patent
Terao et al.

(10) Patent No.: US 7,520,499 B2
(45) Date of Patent: Apr. 21, 2009

(54) WAITING TRAY FOR SHEET PROCESSING TRAY

(75) Inventors: Yasunobu Terao, Tagata-gun (JP); Reiji Murakami, Yokohama (JP); Tokihiko Ise, Tagata-gun (JP); Hajime Yamamoto, Mishima (JP); Hiroyuki Taki, Tagata-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/008,224

(22) Filed: Dec. 10, 2004

(65) Prior Publication Data

US 2006/0066023 A1 Mar. 30, 2006

(30) Foreign Application Priority Data

Sep. 28, 2004 (JP) ..... 2004-282205

(51) Int. Cl.
*B65H 37/04* (2006.01)

(52) U.S. Cl. ..... 270/58.11; 270/58.08; 270/58.12; 270/58.14; 270/58.18

(58) Field of Classification Search ..... 270/58.08, 270/58.11, 58.12, 58.14, 58.18; 399/410; 271/189, 190, 191, 192
See application file for complete search history.

(56) References Cited

U.S. PATENT DOCUMENTS

| | | | |
|---|---|---|---|
| 4,473,425 | A | 9/1984 | Baughman et al. |
| 4,611,741 | A | 9/1986 | Wilson |
| 4,667,208 | A | 5/1987 | Shiraki et al. |
| 4,794,859 | A | 1/1989 | Huseby et al. |
| 4,849,796 | A | 7/1989 | Murakami |
| 4,878,656 | A | 11/1989 | Honjo et al. |
| 4,898,374 | A | 2/1990 | Vermaat |
| 4,917,366 | A | 4/1990 | Murakami et al. |
| 5,020,784 | A | 6/1991 | Asami et al. |

(Continued)

FOREIGN PATENT DOCUMENTS

| | | | |
|---|---|---|---|
| JP | 60-023250 | A | 2/1985 |

(Continued)

OTHER PUBLICATIONS

U.S. Appl. No. 11/008,122, filed Dec. 10, 2004, Sasahara.

(Continued)

*Primary Examiner*—Gene Crawford
*Assistant Examiner*—Leslie A Nicholson, III
(74) *Attorney, Agent, or Firm*—Foley & Lardner LLP

(57) ABSTRACT

A waiting tray is provided in a sheet-conveying path and holds sheets if the sheets need to be post-processed. A processing tray receives sheets conveyed from the waiting tray. It may receive sheets conveyed through the sheet-conveying path and coming not via the waiting tray, before the sheets are post-processed. A conveying mechanism is provided, which causes the sheets to fall, due to gravity, from the waiting tray onto a processing tray. A sheet-aligning mechanism aligns the sheets on the processing tray, at their transverse edges and longitudinal edges. On the processing tray, the sheets are post-processed, forming a bundle. The conveying mechanism conveys the bundle of sheets to a storage tray. An opening is provided between the waiting tray and the processing tray and located at downstream of the waiting tray and processing tray.

25 Claims, 12 Drawing Sheets

U.S. PATENT DOCUMENTS

| | | | | |
|---|---|---|---|---|
| 5,021,837 | A | 6/1991 | Uto et al. | |
| 5,071,112 | A | 12/1991 | Signoretto | |
| 5,098,074 | A | 3/1992 | Mandel et al. | |
| 5,112,034 | A | 5/1992 | Uto et al. | |
| 5,282,611 | A | 2/1994 | Ueda et al. | |
| 5,285,249 | A | 2/1994 | Mahoney | |
| 5,289,251 | A | 2/1994 | Mandel et al. | |
| 5,337,134 | A | 8/1994 | Sato et al. | |
| 5,370,384 | A | 12/1994 | Romanowski | |
| 5,418,606 | A | 5/1995 | Kikuchi et al. | |
| 5,435,544 | A | 7/1995 | Mandel | |
| 5,449,157 | A | 9/1995 | Kawano et al. | |
| 5,451,037 | A | 9/1995 | Lundstrom | |
| 5,590,871 | A | 1/1997 | Okabe et al. | |
| 5,622,359 | A | 4/1997 | Kawano et al. | |
| 5,628,502 | A | 5/1997 | Amarakoon | |
| 5,640,232 | A | 6/1997 | Miyake et al. | |
| 5,676,517 | A | 10/1997 | Lotz | |
| 5,709,376 | A | 1/1998 | Ushirogata | |
| 5,767,884 | A | 6/1998 | Bortolotti et al. | |
| 5,934,140 | A | 8/1999 | Jackson et al. | |
| 5,961,274 | A | 10/1999 | Bors | |
| 5,971,384 | A | 10/1999 | Asao | |
| 6,022,011 | A | 2/2000 | Hirose | |
| 6,065,747 | A | 5/2000 | Khovaylo et al. | |
| 6,092,948 | A | 7/2000 | Altfather | |
| 6,102,385 | A | 8/2000 | Wakamatsu et al. | |
| 6,120,020 | A | 9/2000 | Asao | |
| 6,142,461 | A | 11/2000 | Asao et al. | |
| 6,145,828 | A | 11/2000 | Arai | |
| 6,146,085 | A | 11/2000 | Namba et al. | |
| 6,179,287 | B1 | 1/2001 | Watanabe et al. | |
| 6,231,039 | B1 * | 5/2001 | Chung | 270/58.01 |
| 6,330,999 | B2 * | 12/2001 | Coombs et al. | 270/58.18 |
| 6,336,630 | B1 | 1/2002 | Holtman et al. | |
| 6,354,059 | B1 | 3/2002 | Yoshie et al. | |
| 6,357,753 | B1 | 3/2002 | Yamasaki et al. | |
| 6,371,472 | B1 | 4/2002 | Miyake et al. | |
| 6,450,934 | B1 * | 9/2002 | Coombs | 493/383 |
| 6,505,829 | B2 | 1/2003 | Kawata | |
| 6,550,763 | B2 | 4/2003 | Gordon et al. | |
| 6,581,922 | B2 * | 6/2003 | Kuwata et al. | 270/58.11 |
| 6,600,885 | B2 | 7/2003 | Kida | |
| 6,641,129 | B2 | 11/2003 | Ogita et al. | |
| 6,659,455 | B2 | 12/2003 | Endo et al. | |
| 6,671,492 | B2 | 12/2003 | Mimura et al. | |
| 6,674,983 | B2 | 1/2004 | Enomoto et al. | |
| 6,698,744 | B2 | 3/2004 | Yamada et al. | |
| 6,712,349 | B2 | 3/2004 | Watanabe | |
| 6,722,646 | B2 | 4/2004 | Sekiyama et al. | |
| 6,722,650 | B1 * | 4/2004 | Abbata et al. | 271/213 |
| 6,733,006 | B2 | 5/2004 | Kobayashi et al. | |
| 6,733,007 | B2 | 5/2004 | Sekiyama et al. | |
| 6,767,012 | B2 | 7/2004 | Sasamoto | |
| 6,819,906 | B1 | 11/2004 | Herrmann et al. | |
| 6,824,128 | B2 | 11/2004 | Nagata et al. | |
| 6,848,685 | B2 | 2/2005 | Katsuyama | |
| 6,871,042 | B2 | 3/2005 | Nemura et al. | |
| 6,910,686 | B2 | 6/2005 | Awano | |
| 6,928,259 | B2 | 8/2005 | Sakuma | |
| 6,988,728 | B2 | 1/2006 | Kida | |
| 7,104,538 | B1 | 9/2006 | Kimura et al. | |
| 2002/0047233 | A1 | 4/2002 | Coombs et al. | |
| 2002/0053766 | A1 | 5/2002 | Kubota | |
| 2002/0074708 | A1 | 6/2002 | Nagata et al. | |
| 2002/0163119 | A1 | 11/2002 | Kawata | |
| 2003/0057625 | A1 * | 3/2003 | Kuwata et al. | 270/58.02 |
| 2003/0155705 | A1 | 8/2003 | Sekiyama et al. | |
| 2003/0214090 | A1 | 11/2003 | Kato et al. | |
| 2004/0032073 | A1 | 2/2004 | Sasamoto | |
| 2004/0113348 | A1 | 6/2004 | Awano | |
| 2004/0126163 | A1 | 7/2004 | Asami et al. | |
| 2004/0181308 | A1 | 9/2004 | Hayashi et al. | |
| 2005/0000336 | A1 | 1/2005 | Hattori et al. | |
| 2006/0067766 | A1 | 3/2006 | Terao et al. | |

FOREIGN PATENT DOCUMENTS

| | | | | |
|---|---|---|---|---|
| JP | 61-078162 | U | | 5/1986 |
| JP | 61-108588 | A | | 5/1986 |
| JP | 61-021481 | Y2 | | 6/1986 |
| JP | 61-166470 | A | | 7/1986 |
| JP | 62-008965 | A | | 1/1987 |
| JP | 62-229126 | A | | 10/1987 |
| JP | 63-035756 | U | | 3/1988 |
| JP | 63-154578 | A | | 6/1988 |
| JP | 63-180673 | A | | 7/1988 |
| JP | 63-180660 | U | | 11/1988 |
| JP | 02-055369 | A | | 2/1990 |
| JP | 03-088667 | A | | 4/1991 |
| JP | 04-125248 | A | | 4/1992 |
| JP | 04-079857 | U | | 7/1992 |
| JP | 4-312894 | A | | 11/1992 |
| JP | 04-354756 | A | | 12/1992 |
| JP | 05-238103 | A | | 9/1993 |
| JP | 06-064815 | A | | 3/1994 |
| JP | 06-051970 | U | | 7/1994 |
| JP | 06-094324 | B2 | | 11/1994 |
| JP | 6-99070 | B2 | | 12/1994 |
| JP | 08-026558 | A | | 1/1996 |
| JP | 08-259073 | A | | 10/1996 |
| JP | 09-124216 | A | | 5/1997 |
| JP | 09-216772 | A | | 8/1997 |
| JP | 09-309659 | A | | 12/1997 |
| JP | 10-095563 | A | | 4/1998 |
| JP | 10-279169 | A | | 10/1998 |
| JP | 10-324449 | A | | 12/1998 |
| JP | 11-011786 | A | | 1/1999 |
| JP | 11-043257 | A | | 2/1999 |
| JP | 11-147641 | A | | 6/1999 |
| JP | 11-157729 | A | | 6/1999 |
| JP | 11-208967 | A | | 8/1999 |
| JP | 11-231753 | A | | 8/1999 |
| JP | 11-301912 | A | | 11/1999 |
| JP | 2000-095420 | A | | 4/2000 |
| JP | 2000-159414 | A | | 6/2000 |
| JP | 2003-335450 | A | | 11/2000 |
| JP | 2001-048411 | A | | 2/2001 |
| JP | 2001-089009 | A | | 4/2001 |
| JP | 2001089009 | A | * | 4/2001 |
| JP | 2001-175130 | A | | 6/2001 |
| JP | 2001-316029 | A | | 11/2001 |
| JP | 2002-060118 | A | | 2/2002 |
| JP | 2002-308509 | A | | 10/2002 |
| JP | 2002-321862 | A | | 11/2002 |
| JP | 2002-362825 | A | | 12/2002 |
| JP | 2003081517 | A | * | 3/2003 |
| JP | 2003-171057 | A | | 6/2003 |
| JP | 2003-192210 | A | | 7/2003 |
| JP | 2003-246536 | A | | 9/2003 |
| JP | 2004-142868 | A | | 5/2004 |
| JP | 4164058 | B2 | | 8/2008 |

OTHER PUBLICATIONS

U.S. Appl. No. 11/008,124, filed Dec. 10, 2004, Terao et al.
U.S. Appl. No. 11/008,131, filed Dec. 10, 2004, Terao et al.
U.S. Appl. No. 11/008,132, filed Dec. 10, 2004, Terao et al.
U.S. Appl. No. 11/008,142, filed Dec. 10, 2004, Terao et al.
U.S. Appl. No. 11/008,145, filed Dec. 10, 2004, Terao et al.
U.S. Appl. No. 11/008,147, filed Dec. 10, 2004, Terao et al.
U.S. Appl. No. 11/008,148, filed Dec. 10, 2004, Terao et al.
U.S. Appl. No. 11/008,199, filed Dec. 10, 2004, Terao et al.
U.S. Appl. No. 11/008,222, filed Dec. 10, 2004, Terao et al.
U.S. Appl. No. 11/008,230, filed Dec. 10, 2004, Terao et al.

U.S. Appl. No. 11/008,247, filed Dec. 10, 2004, Terao et al.
U.S. Appl. No. 11/008,248, filed Dec. 10, 2004, Terao et al.
U.S. Appl. No. 11/008,251, filed Dec. 10, 2004, Terao et al.
U.S. Appl. No. 11/008,257, filed Dec. 10, 2004, Terao et al.
U.S. Appl. No. 11/008,271, filed Dec. 10, 2004, Terao et al.
U.S. Appl. No. 11/008,290, filed Dec. 10, 2004, Terao et al.
U.S. Appl. No. 11/008,294, filed Dec. 10, 2004, Terao et al.
U.S. Appl. No. 11/008,295, filed Dec. 10, 2004, Terao et al.
U.S. Appl. No. 11/008,299, filed Dec. 10, 2004, Terao et al.
U.S. Appl. No. 11/008,349, filed Dec. 10, 2004, Terao et al.
U.S. Appl. No. 11/008,350, filed Dec. 10, 2004, Terao et al.
U.S. Appl. No. 11/008,381, filed Dec. 10, 2004, Terao et al.
U.S. Appl. No. 11/008,392, filed Dec. 10, 2004, Terao et al.
U.S. Appl. No. 11/008,567, filed Dec. 10, 2004, Terao et al.
Y. Terao et al., Notice of Allowance and Fee(s) Due, Serial No. 11/008,132, Oct. 6, 2005, 9 pages.
Y. Terao et al., Notice of Allowance and Fee(s) Due, Serial No. 11/008,124, Sep. 30, 2005, 9 pages
U.S. Appl. No. 11/085,226, filed Mar. 22, 2005, Terao et al.
U.S. Appl. No. 11/085,227, filed Mar. 22, 2005, Terao et al.
U.S. Appl. No. 11/085,240, filed Mar. 22, 2005, Terao et al.
U.S. Appl. No. 11/085,241, filed Mar. 22, 2005, Terao et al.
U.S. Appl. No. 11/085,242, filed Mar. 22, 2005, Terao et al.
U.S. Appl. No. 11/085,243, filed Mar. 22, 2005, Terao et al.
U.S. Appl. No. 11/085,244, filed Mar. 22, 2005, Terao et al.
U.S. Appl. No. 11/085,247, filed Mar. 22, 2005, Terao et al.
U.S. Appl. No. 11/085,248, filed Mar. 22, 2005, Terao et al.
U.S. Appl. No. 11/085,250, filed Mar. 22, 2005, Terao et al.
U.S. Appl. No. 11/085,251, filed Mar. 22, 2005, Iizuka et al.
U.S. Appl. No. 11/085,256, filed Mar. 22, 2005, Terao et al.
U.S. Appl. No. 11/085,257, filed Mar. 22, 2005, Terao et al.
U.S. Appl. No. 11/085,264, filed Mar. 22, 2005, Terao et al.
U.S. Appl. No. 11/085,625, filed Mar. 22, 2005, Terao et al.
Y. Terao et al., U.S. PTO Notice of Allowance, Serial No. 11/085,243, Jan. 05, 2006, with attached Notice of Withdrawal from Issue dated Jan. 10, 2006, 10 pgs.
Y. Terao et al., U.S. PTO Office Action, U.S. Appl. No. 11/008,131, Feb. 23, 2006, 9 pgs.
Y. Terao et al., U.S. PTO Office Action, U.S. Appl. No. 11/008,222, Feb. 24, 2006, 12 pgs.
Y. Terao et al., U.S. PTO Office Action, U.S. Appl. No. 11/008,230, Feb. 24, 2006, 11 pgs.
Y. Terao et al., U.S. PTO Office Action, U.S. Appl. No. 11/085,226, Jan. 13, 2006, 9 pgs.
Y. Terao et al., U.S. PTO Office Action, U.S. Appl. No. 11/085,227, Feb. 09, 2006, 9 pgs.
Y. Terao et al., U.S. PTO Office Action, U.S. Appl. No. 11/085,240, Jan. 26, 2006, 8 pgs.
Y. Terao et al., U.S. PTO Office Action, U.S. Appl. No. 11/085,241, Feb. 9, 2006, 9 pgs.
Y. Terao et al., U.S. PTO Office Action, U.S. Appl. No. 11/085,243, Jan. 26, 2006, 6 pgs.
Y. Terao et al., U.S. PTO Office Action, U.S. Appl. No. 11/085,244, Feb. 9, 2006, 7 pgs.
Y. Terao et al., U.S. PTO Office Action, U.S. Appl. No. 11/008,148, Jan. 11, 2006, 12 pages.
Y. Terao et al., U.S. PTO Office Action, U.S. Appl. No. 11/008,251, Jan. 13, 2006, 11 pages.
Y. Terao et al., U.S. PTO Office Action, U.S. Appl. No. 11/008,350, Jan. 26, 2006, 12 pages.
Y. Terao et al., U.S. PTO Office Action, U.S. Appl. No. 11/008,295, Jan. 5, 2006, 11 pages.
Y. Terao et al., U.S. PTO Office Action, U.S. Appl. No. 11/008,392, Dec. 14, 2005, 9 pages.
Y. Terao et al., U.S. PTO Office, U.S. Appl. No. 11/008,294, Dec. 13, 2005, 9 pages.
Y. Terao et al., U.S. PTO Office, U.S. Appl. No. 11/008,299, Dec. 13, 2005, 9 pages.
Y. Terao et al., U.S. PTO Office, U.S. Appl. No. 11/008,349, Dec. 13, 2005, 9 pages.
Y. Terao et al., U.S. PTO Office, U.S. Appl. No. 11/008,567, Dec. 13, 2005, 9 pages.
Y. Terao et al., Notice of Allowance and Fee(s) Due, U.S. Appl. No. 11/008,295, Sep. 21, 2006, 7 pages.
Y. Terao et al., Notice of Allowance and Fee(s), U.S. Appl. No. 11/008,350, Sep. 21, 2006, 7 pages.
Y. Terao et al., Notice Allowance and Fee(s), U.S. Appl. No. 11/008,392, Sep. 15, 2006, 10 pages.
Y. Terao et al., U.S. PTO Office Action, U.S. Appl. No. 11/008,381, Aug. 23, 2006, 17 pages.
Y. Terao et al., U.S. PTO Office Action, U.S. Appl. No. 11/008,567, Aug. 21, 2006, 14 pages.
Y. Terao et al., Notice of Allowance and Fees(s) Due, U.S. Appl. No. 11/008,222, Aug. 31, 2006, 12 pgs.
Y. Terao et al.,Notice of Allowance and Fee(s) Due, U.S. Appl. No. 11/008,299, Sep. 06, 2006, 9 pgs.
Y. Terao et al., Notice of Allowance and Fee(s) Due, U.S. Appl. No. 11/008,148, Jun. 26, 2006, 10 pages.
Y. Terao et al., Notice of Allowance and Fee(s) Due, U.S. Appl. No. 11/008,251, Jun. 26, 2006, 10 pages.
Y. Terao et al., Notice of Allowance and Fee(s) Due, U.S. Appl. No. 11/008,241, Jun. 26, 2006, 10 pages.
Y. Terao et al., Notice of Allowance and Fee(s) Due, U.S. Appl. No. 11/008,243, Jun. 26, 2006, 10 pages.
Y. Terao et al., U.S. PTO Office Action, U.S. Appl. No. 11/008,295, Jun. 23, 2006, 14 pgs.
Y. Terao et al., U.S. PTO Office Action, U.S. Appl. No. 11/008,132, Jun. 06, 2006, with attached Notice of Withdrawal from Issue dated May 30, 2006, 11 pgs.
Y. Terao et al., Notice of Allowance and Fee(s) Due, U.S. Appl. No. 11/085,244, Jul. 13, 2006, 10 pages.
Y. Terao et al., U.S. PTO Office Action, U.S. Appl. No. 11/085,226, Jul. 20, 2006, 12 pages.
Y. Terao et al., U.S. PTO Office Action, U.S. Appl. No. 11/085,227, Aug. 11, 2006, 15 pages.
Y. Terao et al., U.S. PTO Office Action, U.S. Appl. No. 11/085,240, Aug. 2, 2006, 15 pages.
Y. Terao et al., U.S. PTO Office Action, U.S. Appl. No. 11/008,145, Jun. 30, 2006, 6 pgs.
Y. Terao et al., U.S. PTO Office Action, U.S. Appl. No. 11/008,147, Jul. 7, 2006, 4 pgs.
Y. Terao et al., U.S. PTO Office Action, U.S. Appl. No. 11/008,290, Jul. 21, 2006, 15 pgs.
Y. Terao et al., U.S. PTO Office Action, U.S. Appl. No. 11/008,350, Jul. 6, 2006, 12 pgs.
Y. Terao et al., U.S. PTO Office Action, U.S. Appl. No. 11/085,131, Jul. 13, 2006, 14 pgs.
Y. Terao et al., U.S. PTO Office Action, U.S. Appl. No. 11/085,248, Jul. 5, 2006, 15 pgs.
Y. Terao et al., U.S. PTO Office Action, U.S. Appl. No. 11/085,256, Jul. 13, 2006, 13 pgs.
Y. Terao et al., U.S. PTO Office Action, U.S. Appl. No. 11/085,625, Jul. 28, 2006, 13 pgs.
Y. Terao et al., Notice of Allowance and Fee(s) Due, U.S. Appl. No. 11/008,122, Jul. 26, 2006, 8 pgs.
K. Sasahara et al., U.S. PTO Office Action, U.S. Appl. No. 11/008,122, Apr. 19, 2006, 10 pages.
Y. Terao et al., Notice of Allowance and Fee(s) Due, U.S. Appl. No. 11/008,199, Apr. 20, 2006, 15 pages.
Y. Terao et al., Notice of Allowance and Fee(s) Due, U.S. Appl. No. 11/008,247, May 1, 2006, 16 pages.
Y. Terao et al., Notice of Allowance and Fee(s) Due, U.S. Appl. No. 11/008,349, May 2, 2005, 9 pages.
Y. Terao et al., U.S. PTO Office Action, U.S. Appl. No. 11/008,257, Apr. 28, 2006, 13 pages.
Y. Terao et al., U.S. PTO Office Action, U.S. Appl. No. 11/008,271, Apr. 25, 2006, 14 pages.
Y. Terao et al., U.S. PTO Office Action, U.S. Appl. No. 11/008,294, May 5, 2006, 13 pages.
Y. Terao et al., U.S. PTO Office Action, U.S. Appl. No. 11/008,299, May 5, 2006, 12 pages.
Y. Terao et al., U.S. PTO Office Action, U.S. Appl. No. 11/008,392, Apr. 26, 2006, 10 pages.
Y. Terao et al., Notice of Allowance and Fee(s) Due, U.S. Appl. No. 11/008,142, Jan. 5, 2007, 24 pages.

Y. Terao et al., Notice of Allowance and Fee(s) Due, U.S. Appl. No. 11/008,145, Dec. 14, 2006, 20 pages.
Y. Terao et al., Noitce of Allowance and Fee(s) Due, U.S. Appl. No. 11/008,147, Nov. 17, 2006, 7 pages.
Y. Terao et al., U.S. PTO Office Action, U.S. Appl. No. 11/008,248, Jan. 8, 2007, 25 pgs.
Y. Terao et al., U.S. PTO Office Action, U.S. Appl. No. 11/008,248, Oct. 24, 2006, 12 pages.
Y. Terao et al., U.S. PTO Office Action, U.S. Appl. No. 11/008,131, Oct. 17, 2006, 15 pages.
Y. Terao et al., U.S. PTO Office Action, U.S. Appl. No. 11/008,132, Nov. 24, 2006, 16 pages.
Y. Terao et al., U.S. PTO Office Action, U.S. Appl. No. 11/008,230, Nov. 13, 2006, 17 pages.
Y. Terao et al., U.S. PTO Office Action, U.S. Appl. No. 11/008,294, Nov. 24, 2006, 11 pages.
Y. Terao et al., U.S. PTO Office Action, U.S. Appl. No. 11/008,625, Nov. 21, 2006, 13 pages.
Y. Terao et al., Notice of Allowance and Fee(s) Due, U.S. Appl. No. 11/008,257, Nov. 24, 2006, 11 pgs.
Y. Terao et al., U.S. PTO Office Action, U.S. Appl. No. 11/008,122, Nov. 21, 2005, 9 pages.
Y. Terao et al., U.S. PTO Office Action, U.S. Appl. No. 11/008,257, Nov. 30, 2005, 9 pages.
Y. Terao et al., U.S. PTO Office Action, U.S. Appl. No. 11/008,271, Nov. 30, 2005, 9 pages.
Y. Terao et al., U.S. PTO Office Action, U.S. Appl. No. 11/008,290, Nov. 30, 2005, 9 pages.
Y. Terao et al., Notice of Allowance and Fee(s) Due, U.S. Appl. No. 11/008,294, Feb. 6, 2007, 9 pages.
Y. Terao et al., Notice of Allowance and Fee(s) Due, U.S. Appl. No. 11/008,381, Feb. 22, 2007, 23 pages.
Y. Terao et al., Notice of Allowance and Fee(s) Due, U.S. Appl. No. 11/008,567, Mar. 1, 2007, 6 pages.
Y. Terao et al., Notice of Allowance and Fee(s) Due, U.S. Appl. No. 11/085,247, Feb. 28, 2007, 14 pages.
Y. Terao et al., U.S. PTO Office Action, U.S. Appl. No. 11/008,131, Feb. 08, 2007, 22 pages.
Y. Terao et al., U.S. PTO Office Action, U.S. Appl. No. 11/085,226, Jan. 29, 2007, 9 pages.
Y. Terao et al., U.S. PTO Office Action, U.S. Appl. No. 11/008,290, Mar. 9, 2007, 8 pages.
Y. Terao et al., U.S. PTO Office Action, U.S. Appl. No. 11/085,240, Mar. 12, 2007, 15 pages.
Y. Terao et al., U.S. PTO Office Action, U.S. Appl. No. 11/085,242, Mar. 23, 2007, 20 pages.
Y. Terao et al., U.S. PTO Office Action, U.S. Appl. No. 11/085,248, Apr. 10, 2007, 12 pages.
Y. Terao et al., U.S. PTO Office Action, U.S. Appl. No. 11/085,257, Mar. 23, 2007, 23 pages.
Y. Terao et al., U.S. PTO Office Action, U.S. Appl. No. 11/085,264, Mar. 23, 2007, 21 pages.
Y. Terao et al., Notice of Allowance and Fee(s) Due, U.S. Appl. No. 11/008,290, Aug. 2, 2007, 9 pages.
Y. Terao et al., Notice of Allowance and Fee(s) Due, U.S. Appl. No. 11/008,299, Jul. 23, 2007, 10 pages.
Y. Terao et al., Notice of Allowance and Fee(s) Due, U.S. Appl. No. 11/085,240, Aug. 24, 2007, 20 pages.
Y. Terao et al., Notice of Allowance and Fee(s) Due, U.S. Appl. No. 11/085,248, Aug. 16, 2007, 8 pages.
Y. Terao et al., U.S. PTO Office Action, U.S. Appl. No. 11/085,257, Jul. 16, 2007, 12 pgs.
Y. Terao et al., Notice of Allowance and Fee(s) Due, U.S. Appl. No. 11/008,131, Sep. 26, 2007, 12 pages.
Y. Terao et al., U.S. PTO Office Action, U.S. Appl. No. 11/008,199, Aug. 30, 2007, 18 pages.
Y. Terao et al., U.S. PTO Office Action, U.S. Appl. No. 11/008,248, Aug. 22, 2007, 8 pgs.
Y. Terao et al., U.S. PTO Office Action, U.S. Appl. No. 11/085,264, Sep. 12, 2007, 16 pages.
Y. Terao et al., Notice fo Allowance and Fee(s) Due, U.S. Appl. No. 11/822,611, Sep. 25, 2007, 20 pages.
Y. Terao et al., U.S. PTO Office Action, U.S. Appl. No. 11/826,731, Sep. 13, 2007, 21 pages.
C. Iizuka et al., U.S. PTO Office Action, U.S. Appl. No. 11/085,251, Oct. 16, 2007, 10 pages.
Y. Terao et al., Notice of Allowance and Fee(s) Due, U.S. Appl. No. 11/085,242, Nov. 7, 2007, 10 pages.
Y. Terao et al., Notice of Allowance and Fee(s) Due, U.S. Appl. No. 11/085,257, Oct. 31, 2007, 8 pages.
Y. Terao et al., U.S. PTO Office Action, U.S. Appl. No. 11/085,250, Nov. 20, 2007, 13 pages.
Y. Terao et al., U.S. PTO Office Action, U.S. Appl. No. 11/085,625, Nov. 2, 2007, 11 pages.
C. Iizuka et al., Notice of Allowance and Fee(s) Due, U.S. Appl. No. 11/085,251, Apr. 3, 2008, 8 pages.
Y. Terao et al., Notice of Allowance and Fee(s) Due, U.S. Appl. No. 11/008,248, Apr. 7, 2008, 11 pages.
Y. Terao et al., U.S. PTO Office Action, U.S. Appl. No. 11/085,250, Apr. 10, 2008, 7 pgs.
Y. Terao et al., U.S. PTO Office Action, U.S. Appl. No. 11/822,611, Apr. 21, 2008, 18 pgs.
Y. Terao et al., U.S. PTO Office Action, U.S. Appl. No. 11/976,140, Apr. 29, 2008, 27 pgs.
Y. Terao et al., Notice of Allowance and Fee(s) Due, U.S. Appl. No. 11/826,731, Jun. 13, 2008, 5 pages.
Y. Terao et al., Notice of Allowance and Fee(s) Due, U.S. Appl. No. 11/008,199, Jan. 16, 2008, 8 pages.
Y. Terao et al., U.S. PTO Office Action, U.S. Appl. No. 11/826,731, Jan. 14, 2008, 7 pages.
C. Iizuka et al., U.S. PTO Office Action, U.S. Appl. 11/085,251, Jun. 25, 2007, 28 pgs.
Y. Terao et al., Notice of Allowanace and Fee(s) Due, U.S. Appl. No. 11/008,132, Jun. 1, 2007, 11 pgs.
Y. Terao et al., Notice of Allowanace and Fee(s) Due, U.S. Appl. No. 11/008,294, Jun. 14, 2007, 6 pgs.
Y. Terao et al., Notice of Allowanace and Fee(s) Due, U.S. Appl. No. 11/008,381, Jun. 29, 2007, 6 pgs.
Y. Terao et al., U.S. PTO Office Action, U.S. Appl. No. 11/085,242, Jul. 10, 2007, 9 pgs.
Y. Terao et al., U.S. PTO Office Action, U.S. Appl. No. 11/085,250, Jun. 20, 2007, 24 pgs.
Y. Terao et al., U.S. PTO Office Action, U.S. Appl. No. 11/085,625, Jul. 10, 2007, 11 pgs.
Y. Terao et al., Notice of Allowance and Fee(s) Due, U.S. Appl. No. 11/976,140, Oct. 17, 2008, 29 pgs.
Y. Terao et al., U.S. PTO Office Action, U.S. Appl. No. 11/822,611, Oct. 13, 2008, 14 pgs.

* cited by examiner

WAITING TRAY FOR SHEET PROCESSING TRAY

CROSS-REFERENCE TO RELATED APPLICATIONS

This application is based upon and claims the benefit of priority from prior Japanese Patent Application No. 2004-282205, filed Sep. 28, 2004, the entire contents of which are incorporated herein by reference.

BACKGROUND OF THE INVENTION

1. Field of the Invention

The present invention relates to a sheet post-process apparatus, such as a finisher, which is designed for installation at the outlet side of a multi-function periperal (MFP).

2. Description of the Related Art

An apparatus called "finisher" is known, which receives printed sheets supplied from an MFP and staple them together. In the finisher, the sheets supplied from the MFP are sequentially conveyed to a tray and stapled by a stapler, forming a bundle of sheets. The bundle of sheets is ejected from the apparatus onto a storage tray.

Jpn. Pat. Appln. KOKAI Publication No. 6-99070 discloses a finisher. This finisher performs a post-process on sheets. In the post-process, a stapler staples sheets. To process the sheets at the same rate as the MFP processes them, it is necessary to reduce the speed at which sheets are conveyed in the finisher. The finisher therefore has a long sheet-conveying path.

Having a long sheet-conveying path, the finisher cannot be as small as desired.

Jpn. Pat. Appln. KOKAI Publication 2001-175130 discloses a technique of providing a space in the MFP to facilitate the solution to a trouble such as jamming.

BRIEF SUMMARY OF THE INVENTION

An object of the present invention is to provide a sheet post-process apparatus in which a trouble such as jamming can be easily solved.

A sheet post-process apparatus according to this invention comprises: a plurality of rollers which receive sheets from an MFP and convey the sheets forward; a waiting tray which is provided in a conveying path and holds the sheets conveyed from the rollers, when the sheets need to be post-processed; a processing tray which holds the sheets conveyed from the waiting tray and the sheets conveyed via the conveying path without being conveyed to the waiting tray, before the sheets are post-processed; a conveying mechanism which causes the sheets to fall, due to gravity, from the waiting tray onto the processing tray; a sheet-aligning mechanism which aligns the sheets with one another on the processing tray, at transverse edge and longitudinal edge, thereby forming a bundle of sheets; a post-process mechanism which performs a post-process on the bundle of sheets on the processing tray; sheet-conveying means for conveying the bundle of sheets from the processing tray; a storage tray which holds the bundle of sheets; and an opening which is provided between the waiting tray and the processing tray and located at downstream of the waiting tray and processing tray.

Preferably, the length of the waiting tray, measured in the direction of conveying sheets, may be smaller than the width of A4-size sheets or letter-size sheets, measured in the direction of conveying sheets.

The waiting tray and the processing tray may be inclined, each with an upstream part located at a low level.

Preferably, the sheet-aligning mechanism may have a longitudinal-alignment unit and a transverse-alignment unit.

Preferably, the waiting tray has a sheet-alignment mechanism.

In the apparatus, the waiting tray holds sheets to be post-processed. The conveying mechanism causes these sheets to fall, due to gravity, onto the processing tray. Hence, it suffices to provide a sheet-waiting section that is just as long as the waiting tray. This renders the sheet post-process apparatus small.

Since the opening is provided between the waiting tray and the processing tray and located at downstream of the waiting tray and processing tray. Thus, the user can have an easy access to jammed sheets, if any, in the waiting tray and can remove the jammed sheets from the waiting tray.

DETAILED DESCRIPTION OF THE INVENTION

An embodiment of this invention will be described, with reference to the accompanying drawings.

Figure 1:
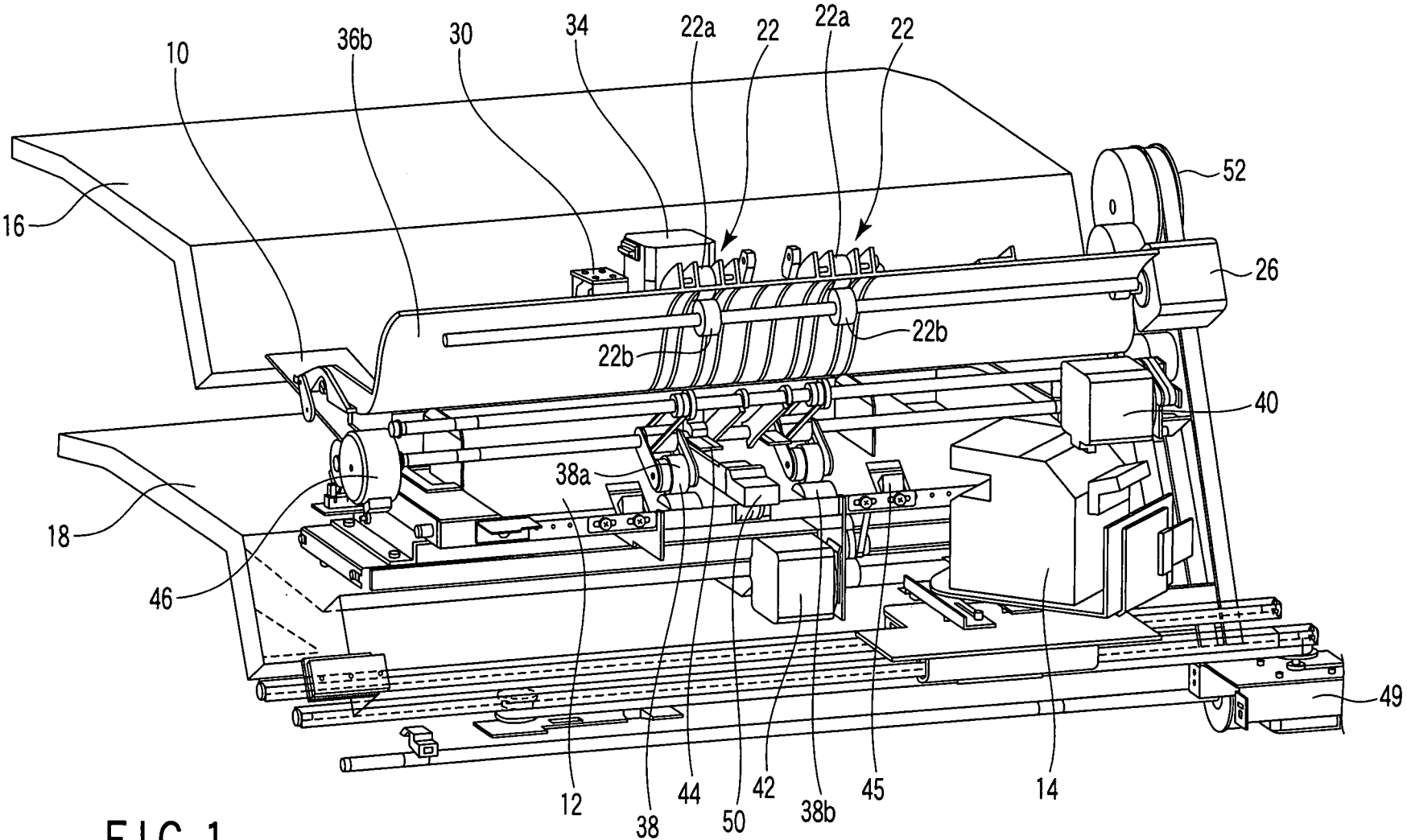
FIG. 1 is a perspective view of a post-process apparatus according to this invention.
Figure 2:
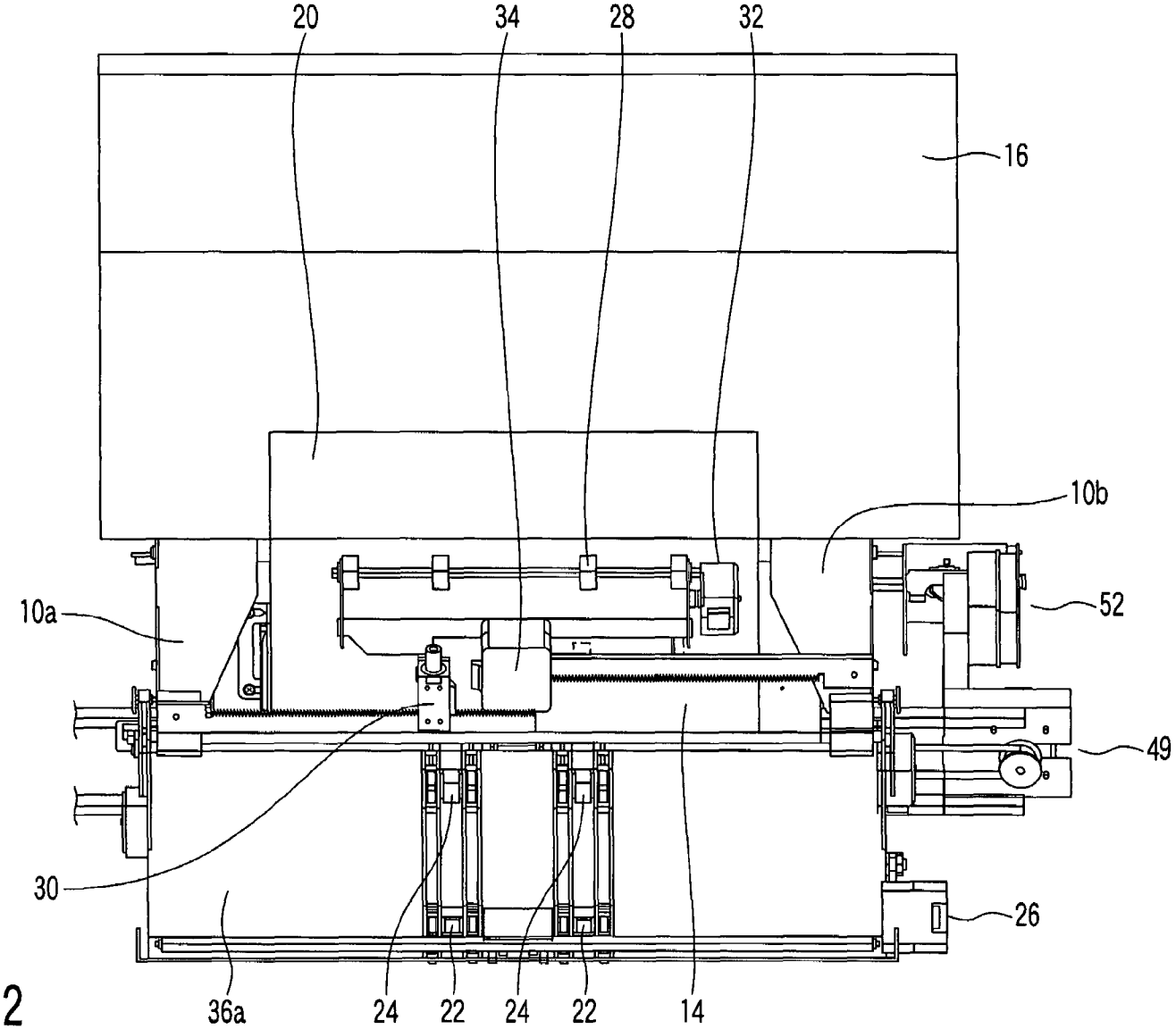
FIG. 2 is a top view of the post-process apparatus according to the invention.

FIG. 1 is a perspective view of a sheet post-process apparatus according to this invention. FIG. 2 is a top view of the post-process apparatus. As FIG. 1 shows, the post-process apparatus comprises a waiting tray 10, a processing tray 12, a stapler 14, a first storage tray 16, and a second storage tray 18.

The sheet post-process apparatus further comprises a pair of input rollers 22, a pair of sheet-feeding rollers 24, and an input-roller motor 26. The input rollers 22 receive a sheet 20 supplied from an MFP and convey the sheet 20 to the sheet-feeding rollers 24. The sheet-feeding rollers 24 convey the sheet 20 to the waiting tray 10. The input-roller motor 26 drives the input rollers 22.

One of the input rollers 22 is an upper input roller 22*a*, and the other input roller 22 is a lower input roller 22*b*. Likewise, one of the sheet-feeding rollers 24 is an upper sheet-feeding roller, and the other sheet-feeding roller 24 is a lower sheet-feeding roller.

The waiting tray 10 comprises two tray parts 10*a* and 10*b*. The tray parts 10*a* and 10*b* can move from left to right, and vice versa. When the tray parts 10*a* and 10*b* take a closed position, the waiting tray 10 can receive sheets. Waiting-tray rollers 28, a waiting-roller drive 30 and a waiting-roller motor 32 are provided. The waiting-tray rollers 28 align sheets on the tray parts 10*a* and 10*b* while both tray parts remain in the closed position. The waiting-tray rollers 28 can move up and down when they are driven and controlled by the waiting-roller drive 30. The waiting-roller motor 32 rotates the waiting-tray rollers 28.

Figure 3:
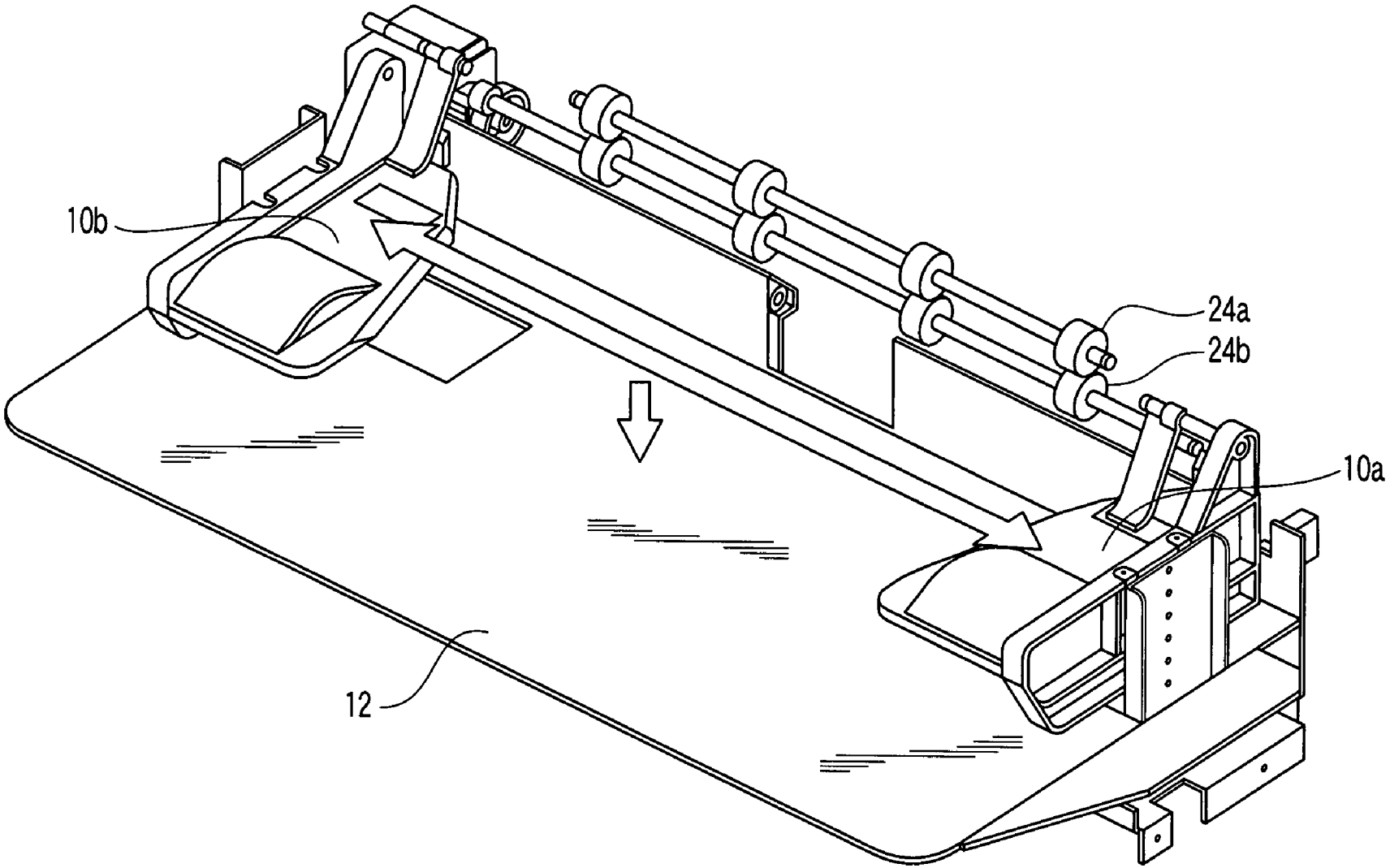
FIG. 3 is a perspective view illustrating how the waiting tray of the post-process apparatus performs its function.

When the number of sheets 20 stacked on the waiting tray 10 reaches a prescribed value, a waiting-tray motor 34 drives the waiting-tray parts 10*a* and 10*b* to an opened position as is illustrated in FIG. 3. The sheets 20 fall onto the processing tray 12, due to gravity. This event is known as "active drop."

The sheet post-process apparatus has a paper guide 36, which guides sheets from the MFP to the waiting tray 10 and thence to the processing tray 12. The paper guide 36 has an upper conveying guide 36*a* and a lower conveying guide 36*b*.

Figure 4:
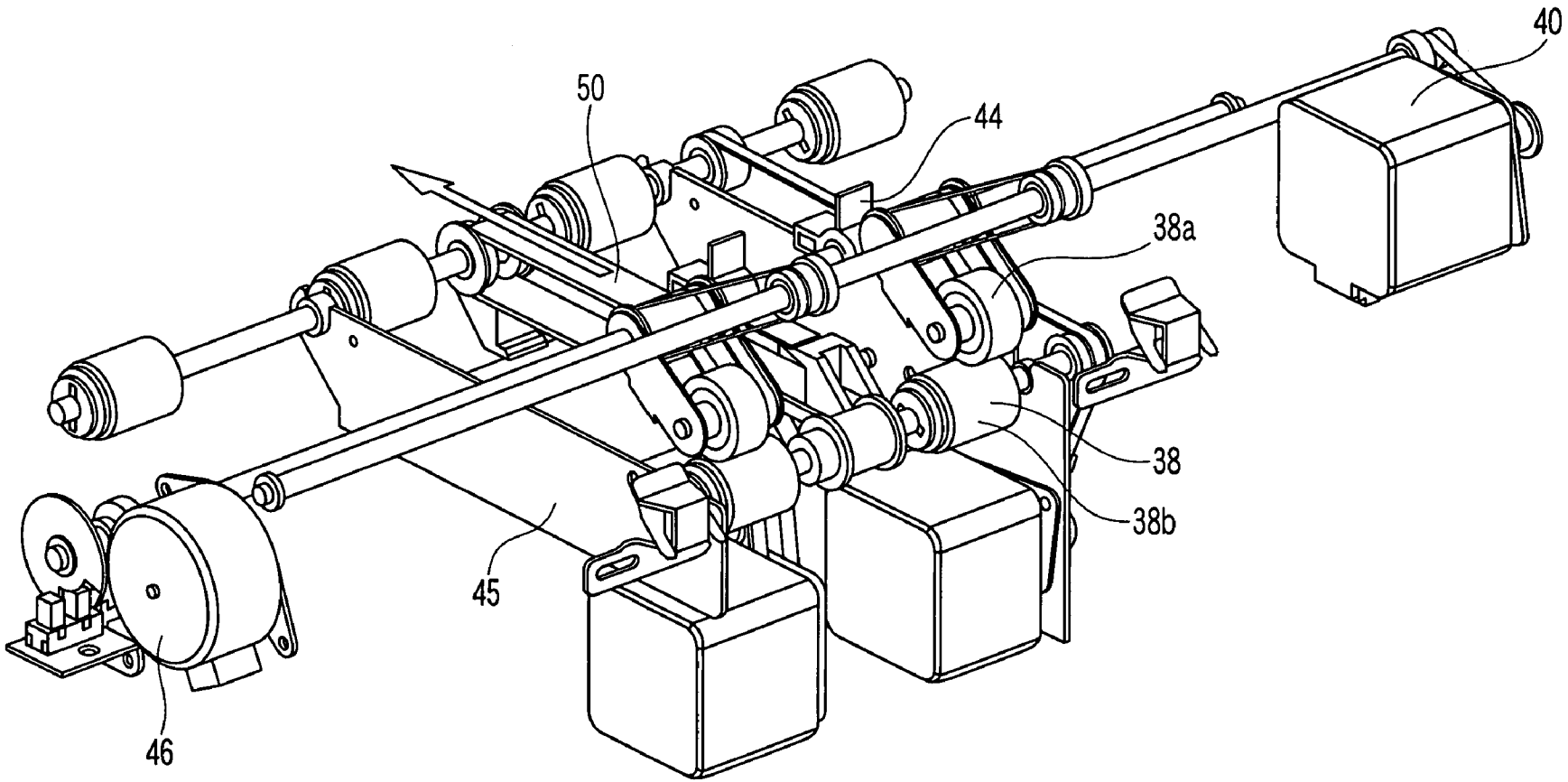
FIG. 4 is a perspective view depicting the sheet-bundle conveying mechanism provided in the post-process apparatus, and explaining how sheets are aligned at longitudinal edges in the post-process apparatus.

In the processing tray 12, the sheets are aligned at the longitudinal edges and the transverse edges. The sheets are aligned at their longitudinal edges by a longitudinal-alignment mechanism 38 as is illustrated in FIG. 4. More precisely, an upper longitudinal-alignment motor 40 drives the upper longitudinal-alignment rollers 38*a* of the mechanism 38, and a lower longitudinal-alignment motor 42 drives the lower longitudinal-alignment rollers 38*b* of the mechanism 38. Driven by the motors 40 and 42, the rollers 38*a* and 38*b* move the sheets until one longitudinal edge of every sheet abuts on a stopper 45. Paddles 44 are provided to facilitate the longitudinal alignment. A paddle motor 46 drives the paddles 44.

Figure 5:
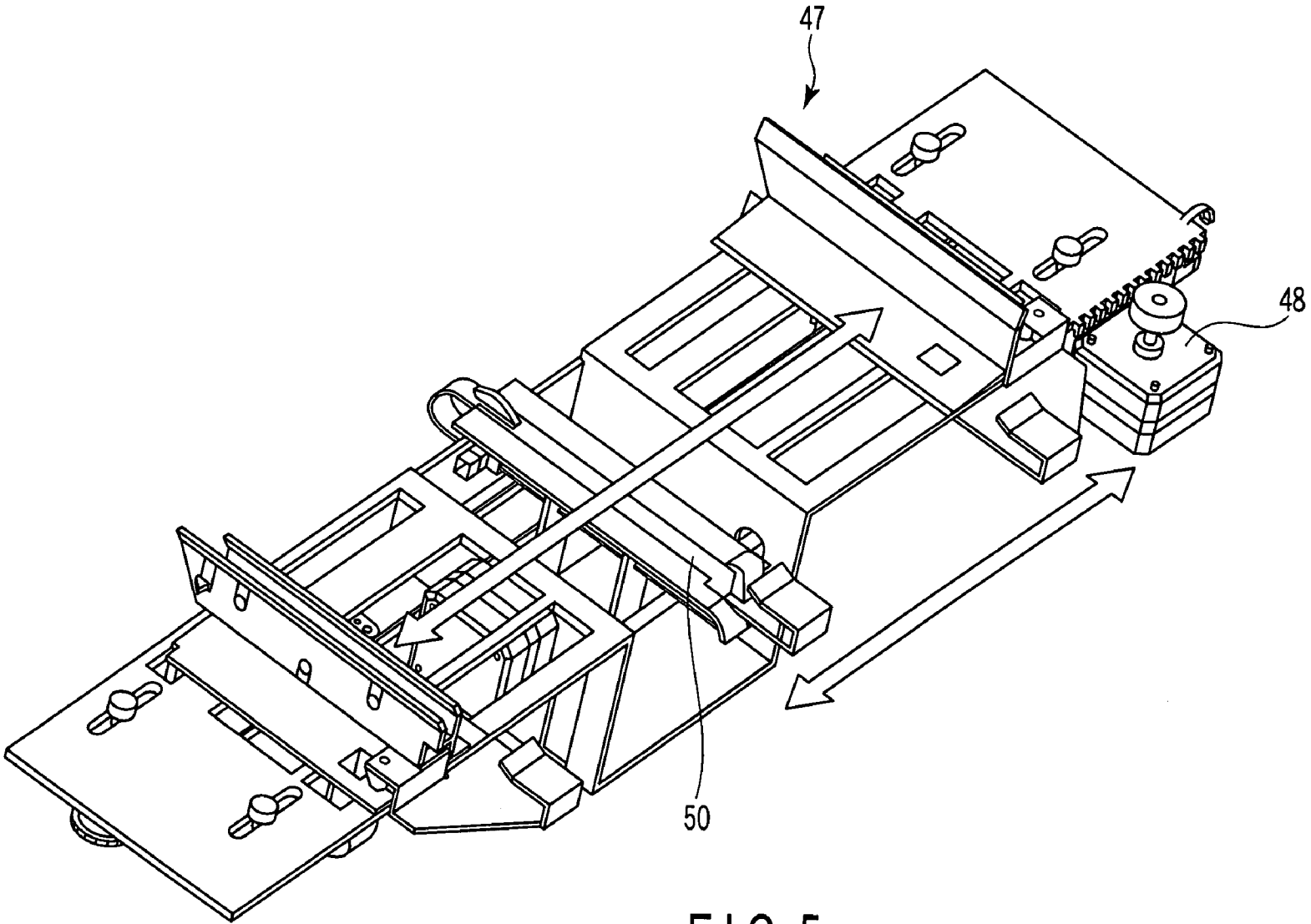
FIG. 5 is a perspective view showing the mechanism for aligning sheets at their transverse edges.

The sheets are aligned at their transverse edges, too, as is illustrated in FIG. 5. More specifically, the transverse alignment is performed by a transverse-alignment mechanism 47 and a transverse-alignment motor 48.

Figure 6:
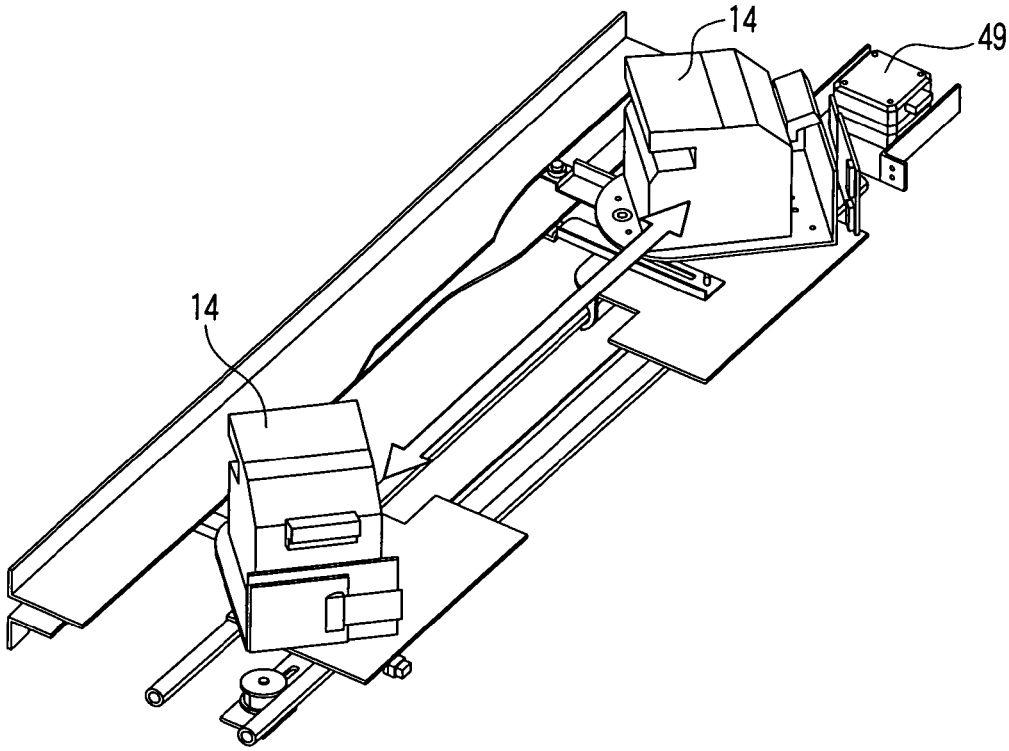
FIG. 6 is a perspective view illustrating how the stapler provided in the post-process apparatus performs its function.

When the number of sheets thus aligned in the processing tray 12 reaches the prescribed value, the stapler 14 starts operating. The stapler 14 is positioned as depicted in FIG. 6 and controlled by a stapler-driving unit 49.

Controlled by the unit 49, the stapler 14 staples the sheets together, forming a bundle of sheets. As shown in FIG. 4, a transport mechanism 50 transports the bundle of sheets to the first storage tray 16. Either the first storage tray 16 or the second storage tray 18 is selected when a storage-tray driving unit 52 (FIG. 2) moves the tray 16 or 18 to a predetermined upper position.

How the post-process apparatus according to this invention operates will be explained with reference to FIGS. 7 to 17.

Figure 7:
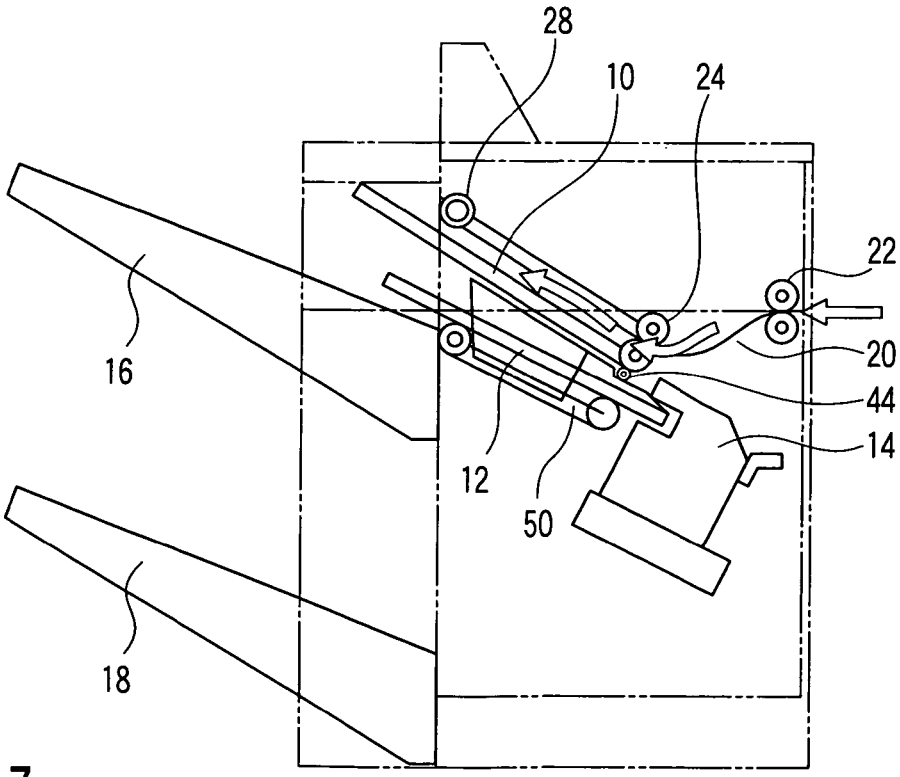
FIG. 7 is a sectional view of the post-process apparatus, showing how the first sheet moves from the input rollers to the sheet-feeding roller.

As FIG. 7 shows, a sheet 20 conveyed from the MFP is moved from the input rollers 22 to the sheet-feeding rollers 24, in the direction of the arrow.

Figure 8:
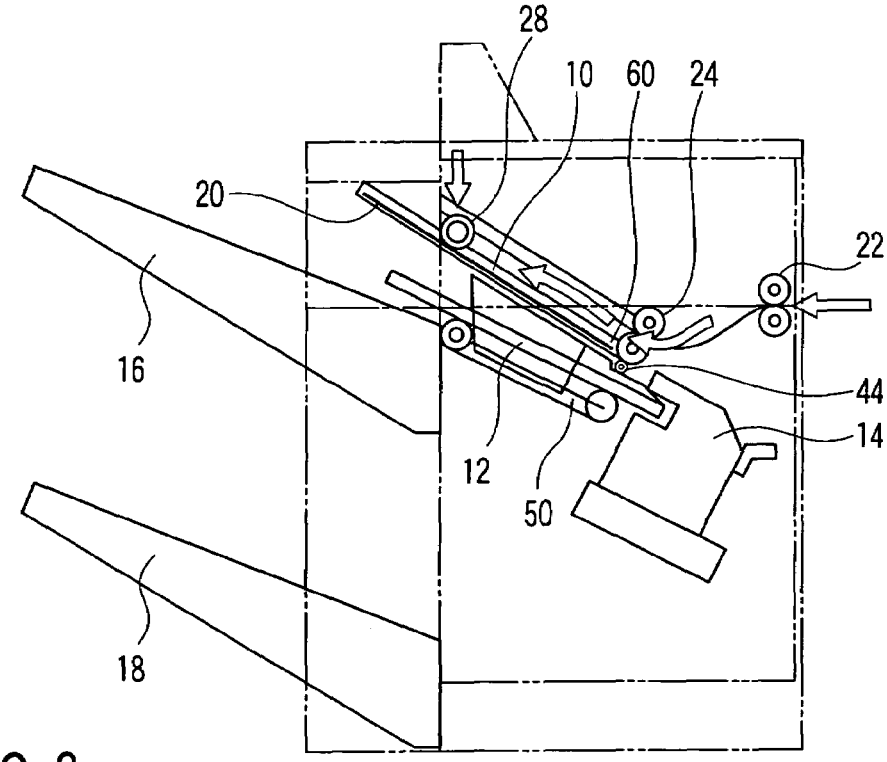
FIG. 8 is a sectional view of the apparatus, explaining how the first sheet moves from the sheet-feeding roller to the waiting tray.

As is illustrated in FIG. 8, the sheet 20, or the first sheet, is placed on the waiting tray 10. Then, the waiting-tray rollers 28 move down, in the direction of the arrow, aligning the trailing edge of the first sheet 20 at the rear (i.e., upstream) end 60 of the waiting tray 10.

Figure 9:
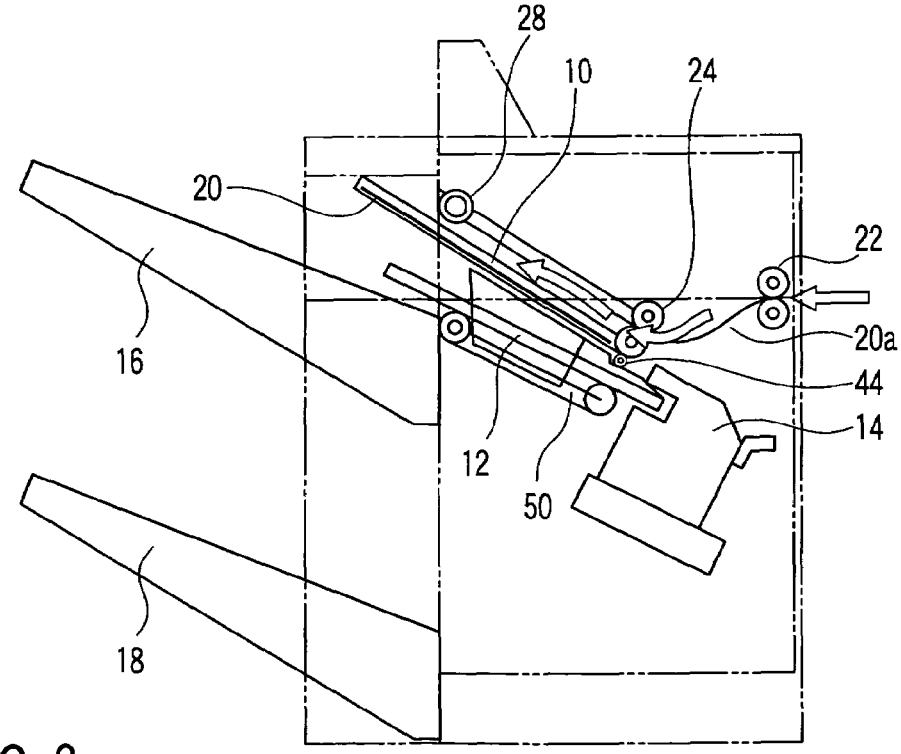
FIG. 9 is a sectional view of the apparatus, explaining how the second sheet moves from the sheet-feeding roller to the waiting tray.

As FIG. 9 depicts, the waiting-tray rollers 28 moves up to receive the second sheet 20*a*.

Figure 10:
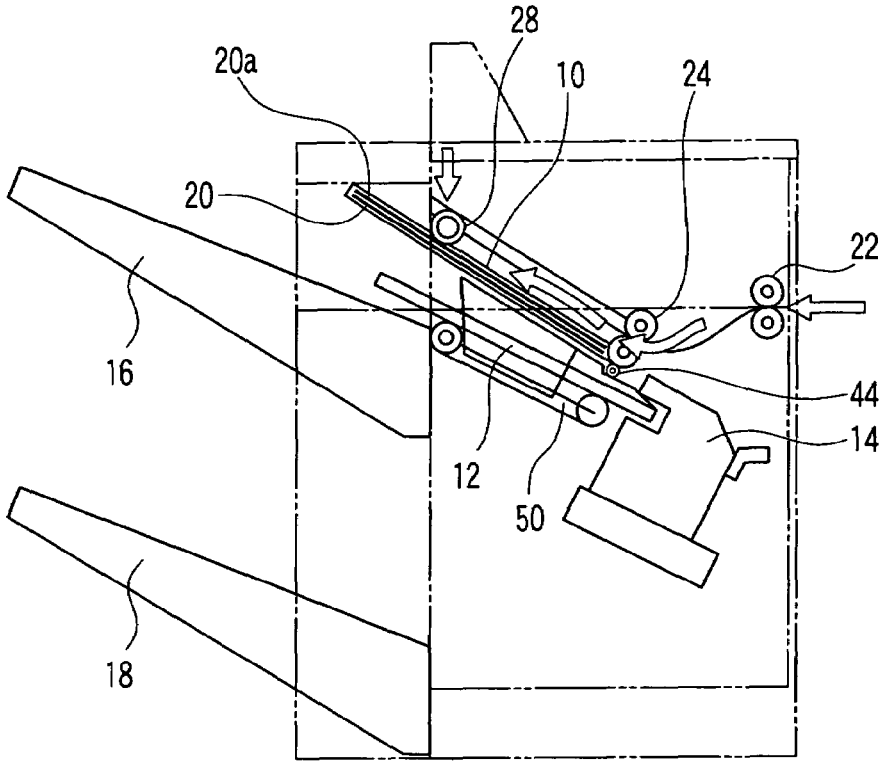
FIG. 10 is a sectional view of the post-process apparatus, showing how the waiting-tray rollers operate.

As FIG. 10 shows, the second sheet 20 is conveyed to the waiting tray 10. The waiting-tray rollers 28 move down, aligning the trailing edge of the second sheet 20*a* at the rear end 60 of the waiting tray 10. Thus, a bundle 20*b* of two sheets 20 and 20*a* is formed in the waiting tray 10.

Figure 11:
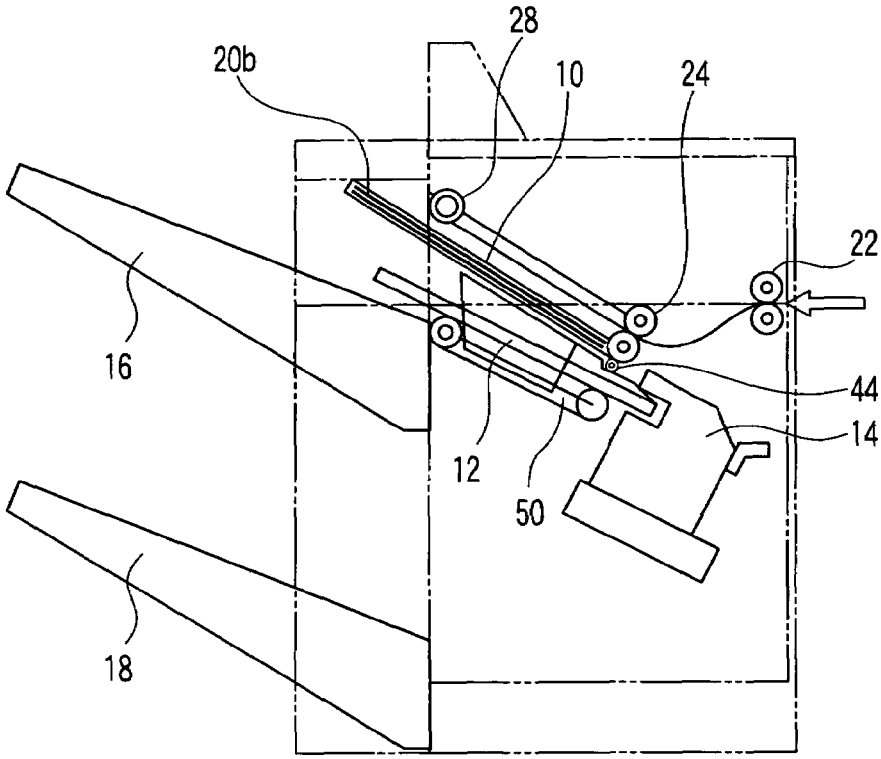
FIG. 11 is another sectional view of the apparatus, illustrating how the waiting-tray rollers operate.
Figure 12:
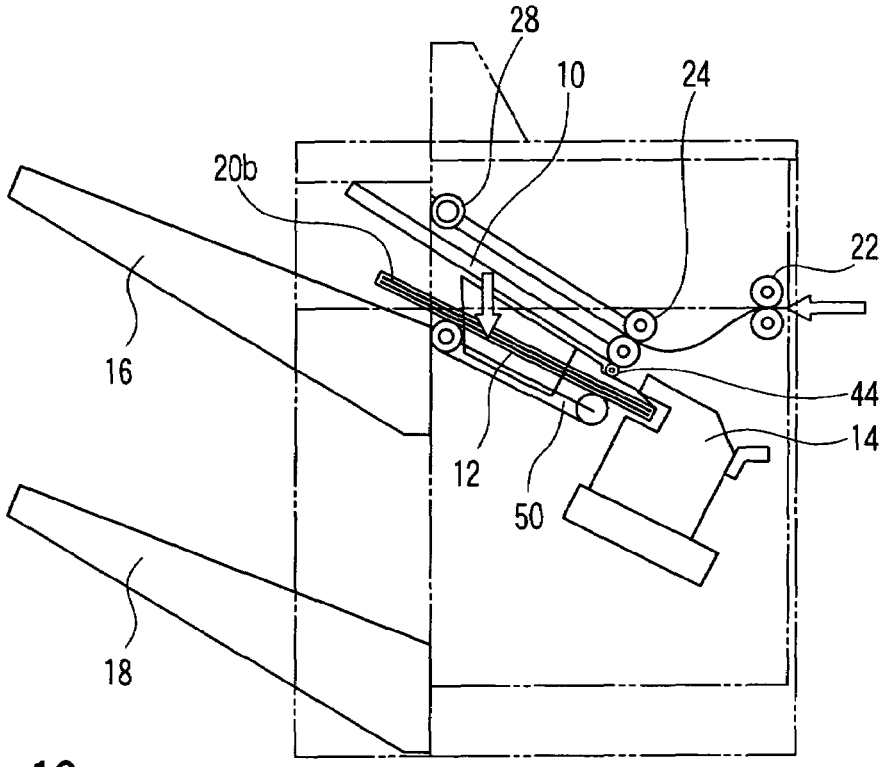
FIG. 12 is a sectional view of the apparatus, explaining how an active drop is carried out.

As FIG. 11 shows, the waiting-tray rollers 28 move upwards. Then, the waiting-tray parts 10*a* and 10*b* move to the opened position as is illustrated in FIG. 3. The active drop is therefore performed as shown in FIG. 12. The bundle 20*b* is conveyed to the processing tray 12.

Thereafter, the third sheet 20*c* and some following sheets are conveyed from the sheet-feeding rollers 24 to the processing tray 12, not through the waiting tray 10. These sheets are laid, one after another, upon the bundle 20*b* of two sheets. A bundle 21, which consists of the prescribed number of sheets, is formed on the processing tray 12. As the sheets including the third sheet 20 are sequentially laid on the bundle 20*b*, the longitudinal-alignment rollers 38 and the transverse-alignment mechanism 47 align the sheets at their longitudinal edges and transverse edges.

Figure 13:
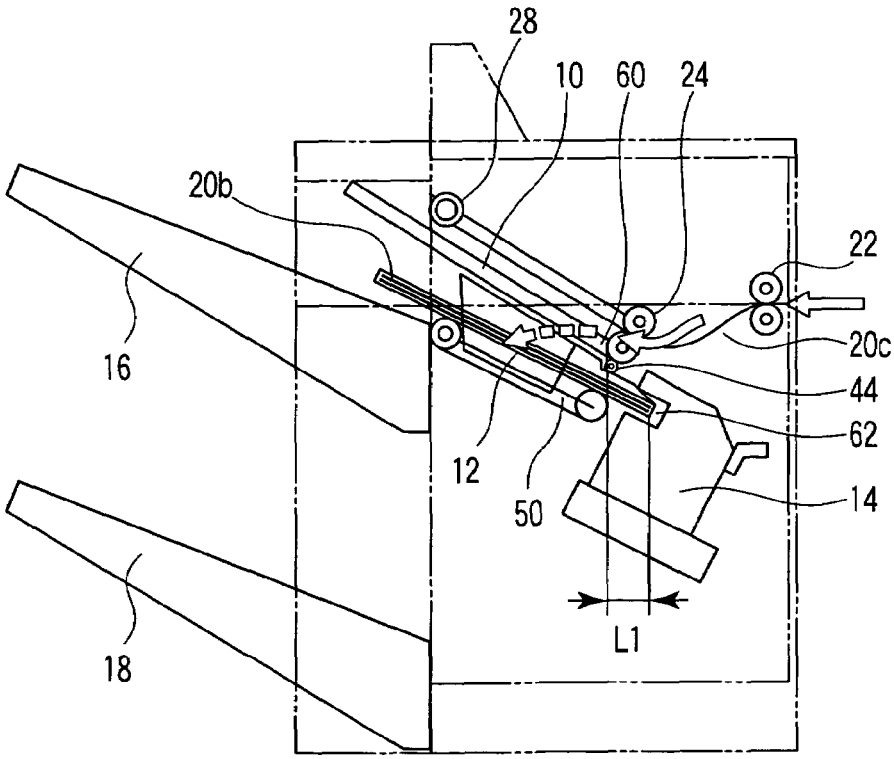
FIG. 13 is a sectional view of the apparatus, explaining how the third sheet is conveyed.

The waiting tray 10 must be positioned so that its rear end 60 may lie downstream of the rear end (upstream-side) of the processing tray 12 when the sheets are laid on the bundle 20*b*. As shown in FIG. 13, the rear end 60 of the waiting tray 10 is therefore spaced from the rear end 62 of the processing tray 12, by distance L1, in the transverse direction. This enables the bundle 20*b* to fall smoothly from the waiting tray 10 onto the processing tray 12. This also makes it easy for both alignment mechanisms 38 and 47 to align sheets. Thus, jamming of sheets can be prevented.

It is desired that the waiting tray 10 and the processing tray 12 be inclined, having their upstream ends at a lower position than their downstream ends. In other words, they should be so positioned that their rear ends 60 and 62 lie at the lowest position. If the trays 10 and 12 are so inclined, the sheets 20 are aligned, due to gravity, at the rear end 60 of the waiting tray 10, and the bundle 20*b* can be aligned, due to gravity, at the rear end and 62 of the processing tray 12.

As seen from FIGS. 10 to 13, the sheet post-process apparatus has the following three characterizing features:

(1) The waiting tray 10 extends longer in the sheet-conveying direction than the length of sheets 20.

(2) The processing tray 12 extends shorter in the sheet-conveying direction than the length of sheets 20.

(3) Because of the feature (2), any sheet 20 that has fallen from the waiting tray 10 onto the processing tray 12 is supported not only by the processing tray 12, but also by the first storage tray 16.

These features (1), (2) and (3) reduce the size of the sheet post-process apparatus (i.e., finisher) in the sheet-conveying direction.

Figure 14:
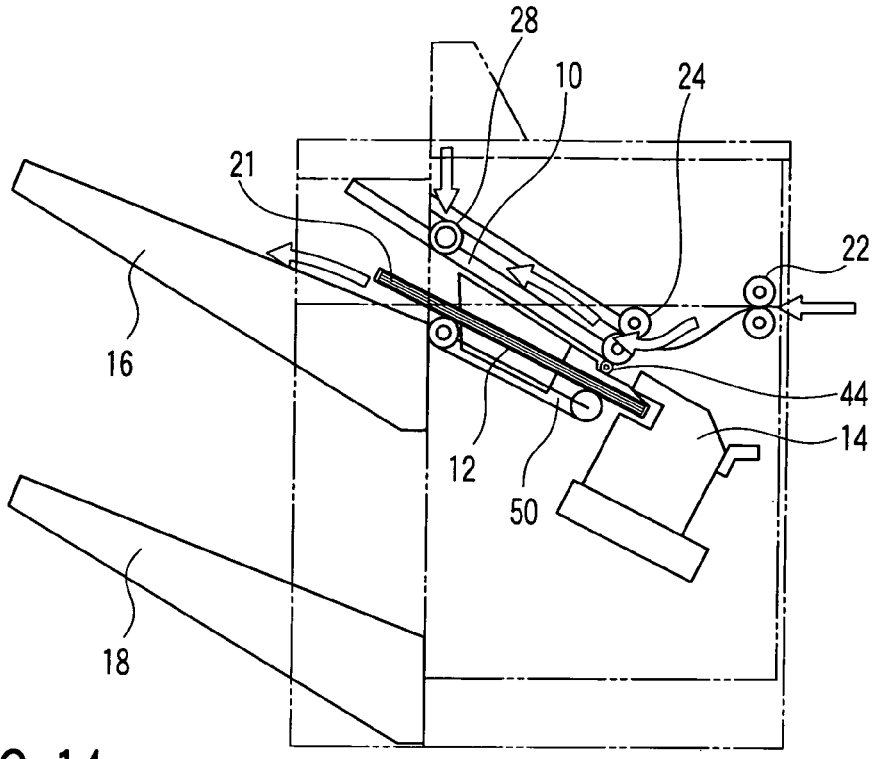
FIG. 14 is a sectional view of the apparatus, illustrating how the stapler operates.
Figure 15:
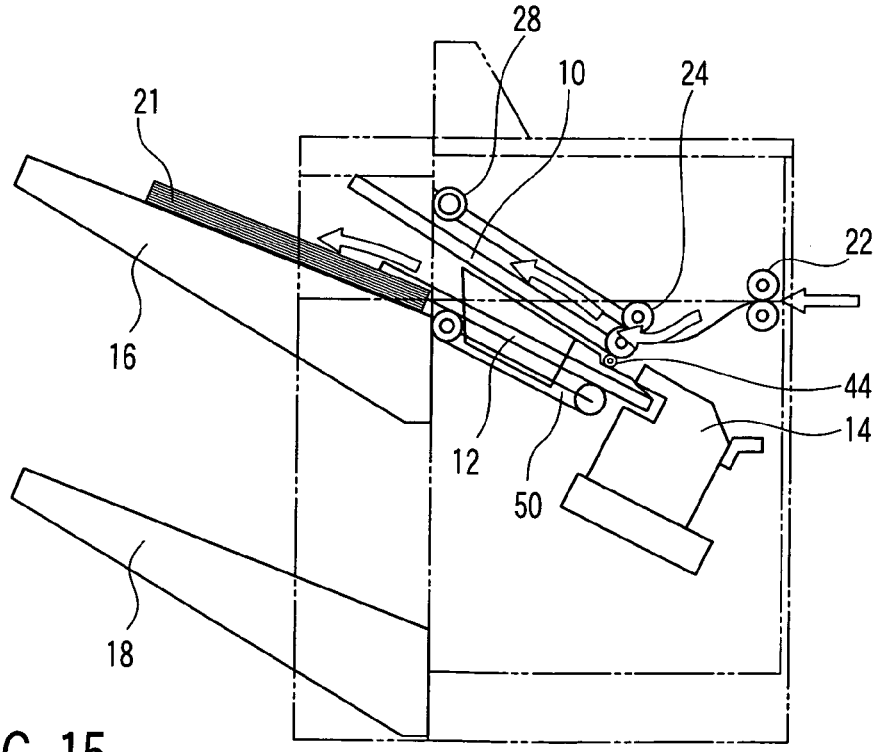
FIG. 15 is a sectional view of the apparatus, explaining how a bundle of sheets move between the processing tray and the storage tray.

As FIG. 14 shows, the stapler 14 staples the bundle 21 of sheets. Then, the transport mechanism 50 transports the bundle 21 to the storage tray 16 as illustrated in FIG. 15. Thus ends the post-process.

Figure 16:
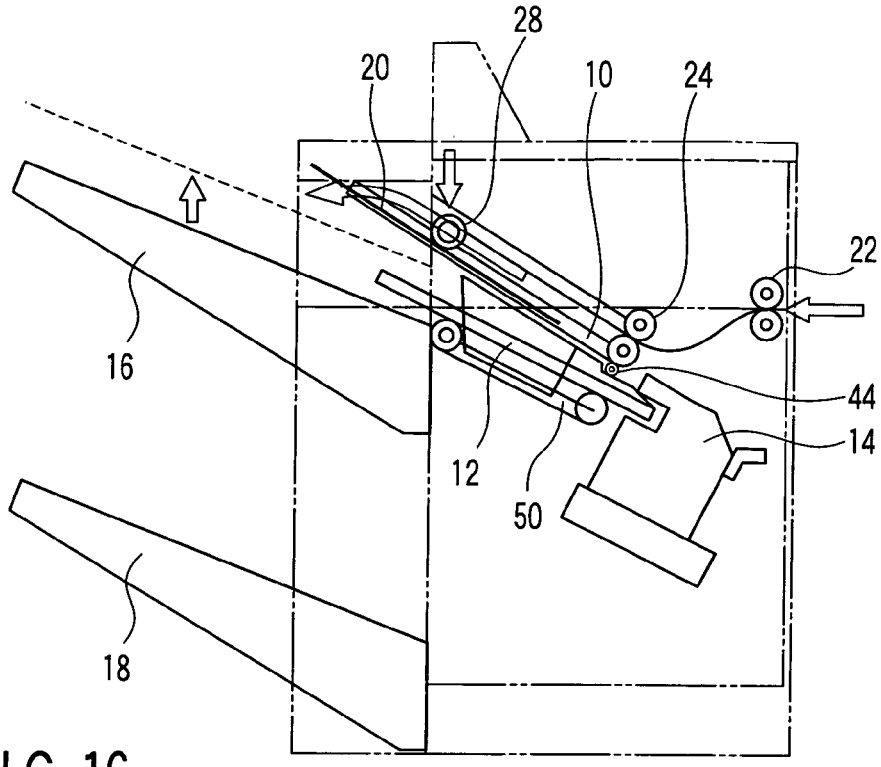
FIG. 16 is a sectional view of the apparatus, illustrating how sheets move from the waiting tray to the storage tray.
Figure 17:
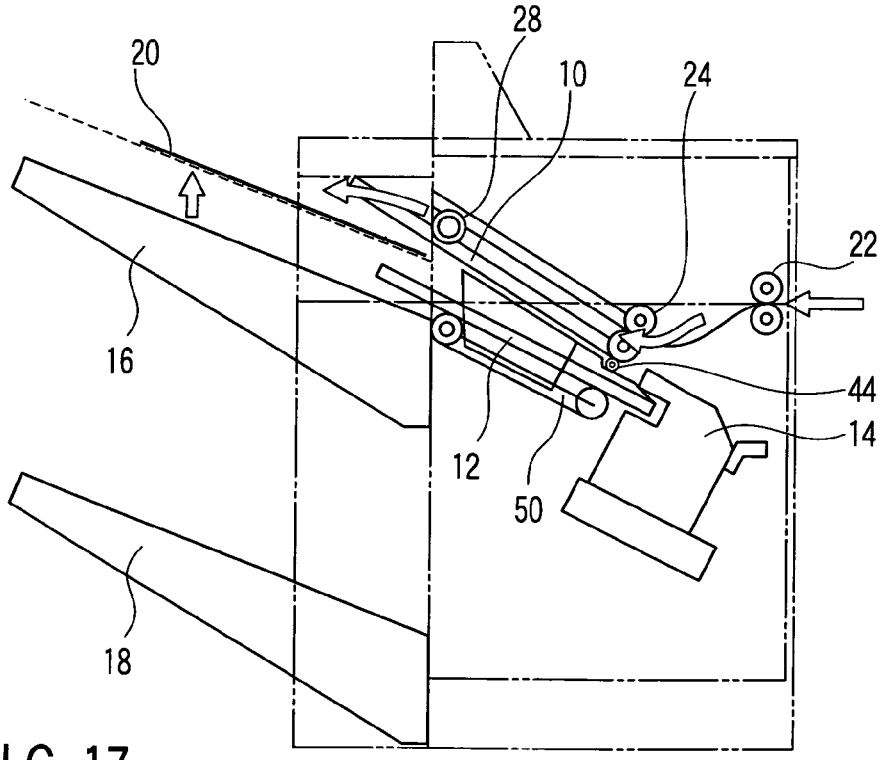
FIG. 17 is a sectional view of the apparatus, explaining how the position of the storage tray is changed.

If the sheets need not undergo the post-process, they are not conveyed to the processing tray 12. They are ejected from the waiting tray 10 onto the first storage tray 16 as shown in FIGS. 16 and 17. As FIG. 16 shows, the sheets supplied from the MFP are sequentially conveyed to the first storage tray 16 via the input rollers 22, sheet-feeding rollers 24 and waiting tray 10. The waiting-tray rollers 28 move down, serving to convey sheets 20. As depicted in FIG. 17, the storage-tray driving unit 52 lifts the first storage tray 16 a little and receives the sheets coming from the waiting tray 10.

Figure 18:
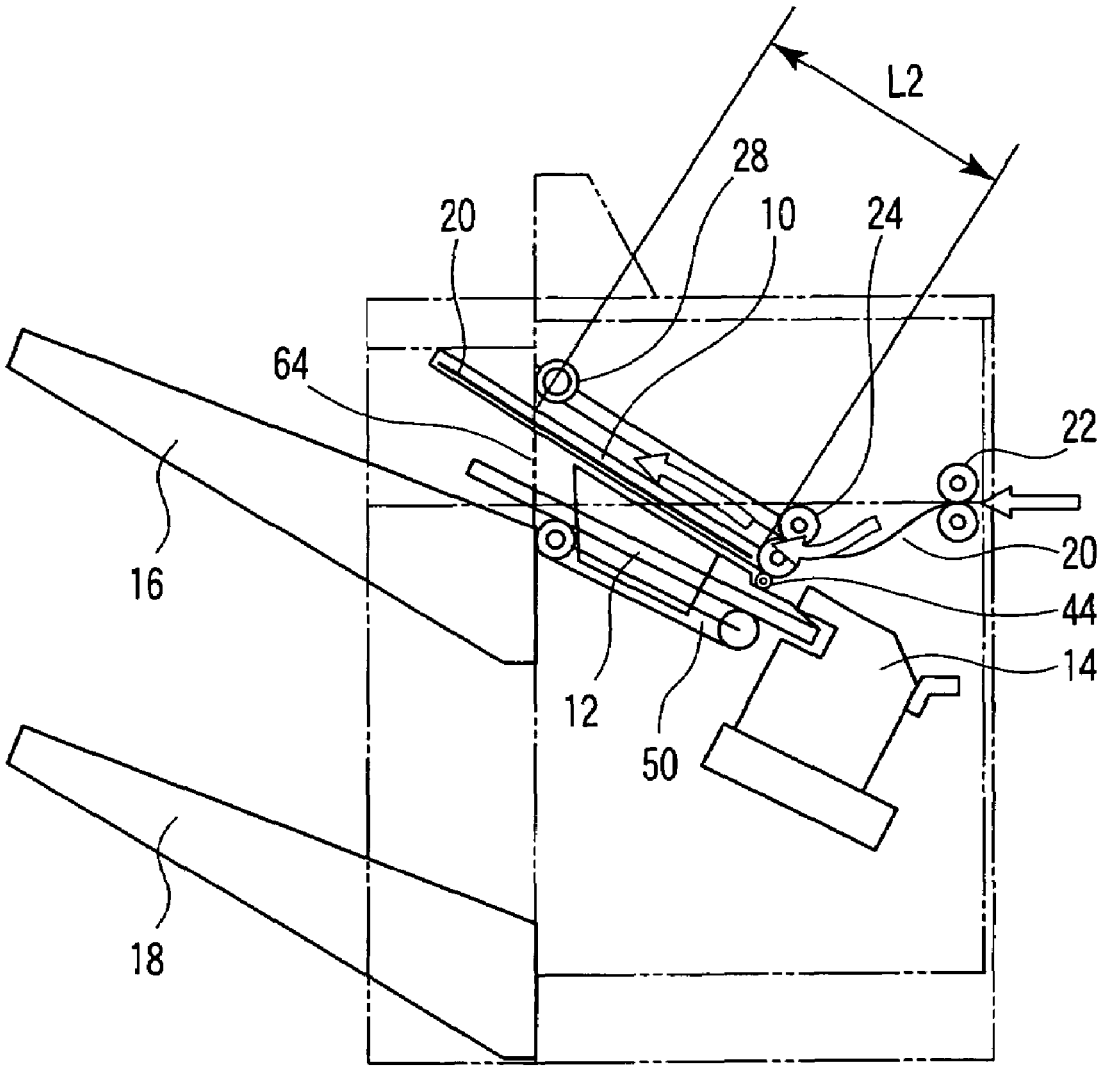
FIG. 18 is a sectional view showing the positional relation between the waiting tray and the processing tray.

The positional relation between the waiting tray 10 and the processing tray 12 will be described, with reference to FIG. 18. An opening 64 is provided between the waiting tray 10 and the processing tray 12 and located at downstream of these trays 10 and 12. That is, the opening 64 is positioned on the sheet-ejecting side of the post-process apparatus. Should jamming occur in the waiting tray 10, the user can remove the jammed sheets 20 from the tray 10 through the opening 64. The opening 64 need not always remain open. Preferably, the opening 64 is a window that can be closed and open.

It is desirable that the waiting tray 10 has a length L2 not exceeding the width of A4-size sheets or letter-size sheets, as measured in the direction of conveying sheets. A4-size sheets have a width of 210 mm as measured in the direction they are conveyed. Letter-size sheets have a width of 216 mm as measured in the direction they are conveyed. The sheets 20 can protrude, in part, from the waiting tray 10 through the opening 64. Hence, the width of the post-process apparatus (finisher) can decreased by the distance that part of each sheet 20 protrudes from the waiting tray 10.

One embodiment of the invention has been described. The invention is not limited to the embodiment, nevertheless. The components described above may be replaced with other components that are identical in function.

What is claimed is:

1. A sheet post-process apparatus, comprising:

a plurality of rollers which receive sheets transferring sequentially from an MFP and convey the sheets forward;

a waiting tray which is provided in a conveying path and holds some of the sheets conveyed from the rollers that are part of a bundle of sheets while previously transferred sheets are being post-processed;

a processing tray which holds the sheets held on and conveyed from the waiting tray and sheets conveyed via the conveying path without being conveyed to the waiting tray that complete the bundle of sheets, wherein the waiting tray opens and closes by a sliding reciprocating motion in a direction of a sheet width with respect to a conveying direction of the conveyed sheets and causes the sheets held on the waiting tray to fall in an opening created by opening of the sliding reciprocating motion of the waiting tray, due to gravity, onto the processing tray;

a sheet-aligning mechanism which aligns the bundle of sheets held on the processing tray with one another, at a transverse edge and a longitudinal edge;

a post-process mechanism which performs a post-process on the bundle of sheets on the processing tray;

a sheet-conveying mechanism which conveys the bundle of sheets from the processing tray; and a storage tray which holds the bundle of sheets processed on the processing tray.

2. The sheet post-process apparatus according to claim 1, wherein the length of the waiting tray, measured in the direction of conveying sheets, is smaller than the width of A4-size sheets or smaller than the width of letter-size sheets.

3. The sheet post-process apparatus according to claim 1, wherein the waiting tray and the processing tray are inclined, each with an upstream part located at a low level.

4. The sheet post-process apparatus according to claim 1, wherein the sheet-aligning mechanism has a longitudinal-alignment unit and a transverse-alignment unit.

5. The sheet post-process apparatus according to claim 1, wherein the waiting tray has a sheet-alignment mechanism.

6. The sheet post-process apparatus according to claim 1, further comprising ejecting rollers configured to eject the sheets directly from the waiting tray to the storage tray.

7. The sheet post-process apparatus according to claim 1, wherein a rear end of the processing tray is positioned upstream of a rear end of the waiting tray.

8. The sheet post process apparatus according to claim 1, wherein the waiting tray temporarily retains the conveyed sheets in a waiting mode and releases the sheets to the processing tray.

9. A sheet post-process apparatus, comprising:

first means for receiving sheets transferring sequentially from an MFP and convey the sheets forward;

second means provided in a conveying path, for holding some of the sheets conveyed from the first means that are part of a bundle of sheets while previously transferred sheets are being post-processed;

third means for holding the sheets held on and conveyed from the second means and sheets conveyed via the conveying path without being conveyed to the second means that complete the bundle of sheets, the second means opening and closing by a sliding reciprocating motion in a direction of a sheet width with respect to a conveying direction of the conveyed sheets and causing the sheets held on the second means to fall, due to gravity, onto the third means;

fifth means for aligning the bundle of sheets held on the third means with one another, at a transverse edge and a longitudinal edge;

sixth means for performing a post-process on the bundle of sheets on the third means;

seventh means for conveying a processed bundle of sheets from the sixth means;

eighth means for holding the processed bundle of sheets processed by the sixth means.

10. The sheet post-process apparatus according to claim 9, wherein the length of the second means, measured in the direction of conveying sheets, is smaller than the width of A4-size sheets or smaller than the width of letter-size sheets.

11. The sheet post-process apparatus according to claim 9, wherein the second means and the third means are inclined, each with an upstream part located at a low level.

12. The sheet post-process apparatus according to claim 9, wherein the fifth means has a longitudinal-alignment unit and a transverse-alignment unit.

13. The sheet post-process apparatus according to claim 9, wherein the second means has a sheet-alignment mechanism.

14. The sheet post-process apparatus according to claim 9, further comprising means for ejecting the sheets directly from the second means to the eighth means.

15. The sheet post-process apparatus according to claim 9, wherein a rear end of the third means is positioned upstream of a rear end of the second means.

16. The sheet post process apparatus according to claim 9, wherein the second means temporarily retains the conveyed sheets in a waiting mode and releases the sheets to the processing tray.

17. A sheet processing apparatus, comprising:

a buffering mechanism provided in a conveying path, which temporary holds sheets conveyed from a conveying member that are part of a bundle of sheets and aligns the sheets when waiting is requested for processing previously conveyed sheets;

a processing mechanism which holds sheets conveyed from the buffering mechanism and sheets conveyed through the conveying path without being held by the buffering mechanism that complete the bundle of sheets, and aligns the bundle of sheets held on the processing mechanism with one another, at a traverse edge and longitudinal edge, when a number of sheets being held by the processing mechanism reaches a predetermined number, wherein the buffering mechanism is arranged between the processing mechanism and the conveying member and includes a sliding opening section which opens and closes by a sliding motion and a sliding reciprocating motion in a direction of a sheet width with respect to a conveying direction of the conveyed sheets causing the sheets held on the buffering mechanism to fall through an opening present by open of the sliding reciprocating motion in the buffering mechanism, due to gravity, onto the processing mechanism;

a post-process mechanism which performs a post-process on the bundle of sheets on the processing mechanism; and a storage tray which holds the bundle of sheets processed by the processing mechanism and further processed by the post-process mechanism.

18. The sheet processing apparatus according to claim 17, wherein the buffering mechanism including a length in a direction of conveying the sheets, is smaller than a width of A4-size sheets or smaller than a width of letter-size sheets.

19. The sheet processing apparatus according to claim 18, wherein the buffering mechanism and the processing mechanism are inclined, each with an upstream part located at a low level.

20. The sheet processing apparatus according to claim 17 wherein the processing mechanism has a longitudinal-alignment unit and a transverse-alignment unit.

21. The sheet processing apparatus according to claim 17, wherein the buffering mechanism has a sheet-alignment mechanism.

22. The sheet processing apparatus according to claim 17, further comprising ejecting rollers configured to eject the sheets directly from the waiting tray to the storage tray.

23. The sheet processing apparatus according to claim 17, wherein a rear end of the processing tray is positioned upstream of a rear end of the waiting tray.

24. The sheet processing apparatus according to claim 17, wherein the buffering mechanism temporarily retains the conveyed sheets in a waiting mode and releases the sheets to the processing mechanism.

25. A method for processing a sheet, comprising:

buffering sheets conveyed by a conveying member that are part of a bundle of sheets when waiting is requested for a processing being carried out on previously conveyed sheets;

aligning the sheets by a sliding reciprocating motion in a direction of a sheet width with respect to a conveying direction of the conveyed sheets and making the sheets being buffered for processing to fall by the sliding reciprocating motion and due to gravity when the number of sheets being held reaches a predetermined number;

conveying buffered sheets and sheets not requiring buffering that complete the bundle of sheets for processing; and processing the buffered sheets and the sheets not requiring buffering when a number of sheets reaches a predetermined number.

* * * * *